US006142387A

United States Patent [19]

Jou

[11] Patent Number: 6,142,387

[45] Date of Patent: Nov. 7, 2000

[54] MULTIPURPOSE AIR FOUNTAIN

[76] Inventor: Wuu-Cheau Jou, No. 95, Cheng Kung 2nd Road, Tali City, Tiachung Hsien, Taiwan

[21] Appl. No.: 09/173,448

[22] Filed: Oct. 16, 1998

[51] Int. Cl.[7] ..... A62C 31/02; B05B 7/02

[52] U.S. Cl. ..... 239/390; 239/391; 239/396; 239/525; 239/526; 239/DIG. 21; 239/DIG. 22

[58] Field of Search ..... 239/390, 391, 239/396, 436, 442, 525, 526, DIG. 21, DIG. 22

[56] References Cited

U.S. PATENT DOCUMENTS

| | | | |
|---|---|---|---|
| 2,604,361 | 7/1952 | Yates | 239/391 X |
| 3,208,673 | 9/1965 | Kautz | 239/390 X |
| 3,980,238 | 9/1976 | Adiletta | 239/DIG. 22 |
| 4,091,999 | 5/1978 | Voos | 239/DIG. 22 |
| 4,776,517 | 10/1988 | Heren | 239/391 |

*Primary Examiner*—Andres Kashnikow
*Assistant Examiner*—Robin O. Evans
*Attorney, Agent, or Firm*—Rosenberg, Klein & Lee

[57] ABSTRACT

The present invention relates to a multipurpose air fountain, and more particularly to an air fountain which can join with various blowpipes and accessory components to assemble an especial air tool for meeting different purposes—like a cleaning air gun, an inflating gun, a blasting dust gun and a painting spray gun. The present invention provides an air fountain that can connect with different length blowpipes, which can swivel to any orientation to improve the flexibility of the operation and to meet the necessaries of variety working places. The blowpipe can be replaced with an inflating adapter so that the air fountain works as an inflating gun for the tire. As attaching a spraying adapter, by a manifold with an extending hose, the air fountain can be refitted into a cleaning gun with a good absorbing effect. By means of the various attachments, the air fountain provided by the present invention can be refitted into a blast gun, an inflating gun, a cleaning gun or a painting gun.

1 Claim, 20 Drawing Sheets

MULTIPURPOSE AIR FOUNTAIN

BACKGROUND OF THE INVENTION

1. Field of the Invention

The present invention relates to a multipurpose air fountain, and more particularly to an air fountain which can join with various blowpipes and accessory components to assemble an especial air tool for meeting different purposes—like a cleaning air gun, an inflating gun, a blasting dust gun and a painting spray gun.

2. Description of Prior Art

In accordance with a common conventional air fountain 10, as shown on FIG. 18, it is used for blasting dirt dust, iron scurf, etc., in which the blow-pipe 11 is embedded and fixed on the main holder 12 for preventing it from loosing, so the length of the blowpipe 11 is constant, and unable to be changed. For meeting the different necessaries of working space conditions, the user should dispose more than one air gun with different lengths of blow-pipe so that the operator can choice the most convenient one to meet the work space situation. So the production cost will be increased. In addition, because the embedded blowpipe 11 can not be swivelled, the operator will feel very inconvenience as working on a lower space like nearing the bottom side of the machine. For example, if operator want to clean the bottom side of a drilling machine, he has to squat lower and turn over his wrist holding the air gun so that the jet opening aim at the bottom side of the working table, it will put the operator into tired easily, even though like that, there are some places can not be got.

In the garage, the blasting dust air gun is an essential tool, and the tire inflating air gun is an other necessity tool, but in general, every working site is distributed only one outlet of the compressed air so that the worker often has to change the blast gun and the inflating gun alternately. It put the worker into inconvenience.

As cleaning the engine outside surface in the common garage, by means of spraying the chemical detersives like diesel oil or toluene, and co-operating with a brush, the grease spots are brushed off. But the inside surface, due to the high accuracy requirement of the inside of the engine, any scratching trace is not allowed existing, so the brush can not be used in this situation. The cleaning gun 20 becomes the best of clean tool, as shown on FIG. 19, nearing the jet opening of the cleaning gun 20, a T extending manifold 21 is built upon, and fastened with a hose 22. The free end of the hose 22 extends into the inside of a tank 23, thereby absorb the toluene (or diesel oil) into the nozzle to mix with air, then jetted out to wash the inside of the engine. If the hose 22 is longer than a certain length, the absorbing force is not able to pump enough liquid up to produce a good clean effect. And in general, 1 meter length of the hose 22 is a limit to provide essential absorbing force to pump the liquid up, so the operator will be limited in about 1 meter radius. But the operator usually works over 1.5 meters radius, hence the operator has to move the engine or the toluene tank 23 as working. It puts the operator to inconvenience.

1. Additionally, painting procedure is claimed with a high rate in common mechanical factories and garages, timber mills and so on. The main tool in the painting procedure is painting gun, as shown in FIG. 20. The spraying principle of the painting gun is the same as the cleaning gun 20 By securing a painting nozzle 30 on front tip of a conventional air fountain 10 which extends a manifold 31 connecting a hose 311, and the hose 311 is placed into a paint can attached on the bottom side of the painting nozzle 30, the paint is absorbed up from the bottom of the paint can via the hose 311 by the jetting air flow. Nearing the front end of the painting nozzle 30, a pair of radial through holes 32 is built upon for leading the outside air in, as spraying the paint and air, to reduce the jet air pressure and atomised paint pressure to avoid the jetted paint reflecting as touching against the surface of the work-piece so as to prevent the paint form unsticking. Meanwhile the jetted atomised paint appears a radiant cone so that the paint can be sprayed on the surface of work-piece evenly. This is a main feature of the conventional painting nozzle 30. But the shortcoming of the painting nozzle 30 is the same as the cleaning gun. Due to the limit of the absorbing force, and the high viscosity of the paint near the bottom side, spraying mere air is often happened.

OBJECTS AND SUMMARY OF THE INVENTION

In view of the above-mentioned shortcomings of the conventional air fountain, the present invention provides an air fountain that can connect with different length blowpipes, which can swivel to any orientation to improve the flexibility of the operation and to meet the necessaries of variety working places. The blowpipe can be replaced with an inflating adapter so that the air fountain works as an inflating gun for the tire. As attaching a spraying adapter, by a manifold with an extending hose, the air fountain can be refitted into a cleaning gun with a good absorbing effect. By means of the various attachments, the air fountain provided by the present invention can be refitted into a blast gun, an inflating gun, a cleaning gun or a painting gun.

DETAILED DESCRIPTION OF PREFERRED EMBODIMENTS

Figure 1:
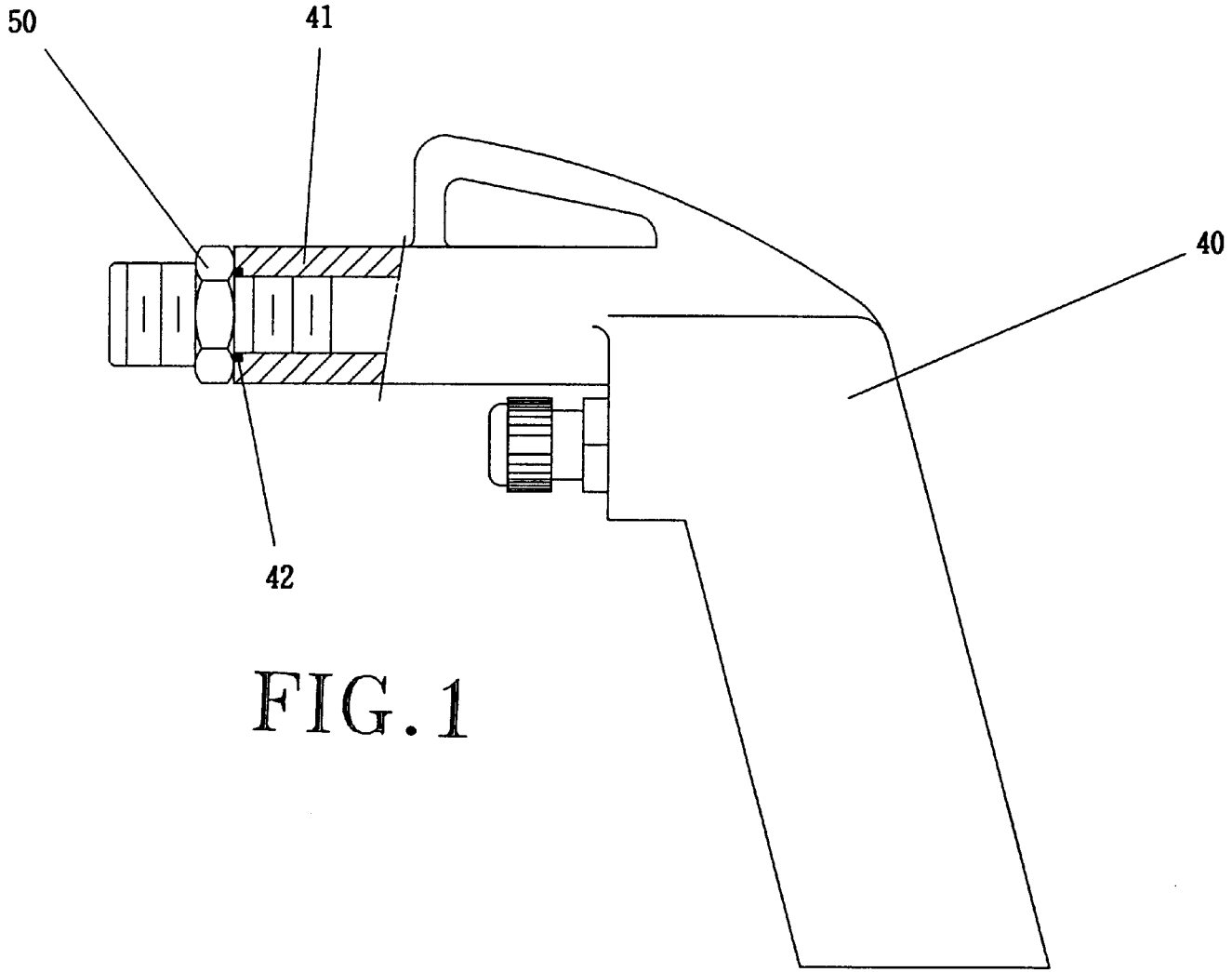
FIG. 1 is a side view of the present invention.
Figure 2:
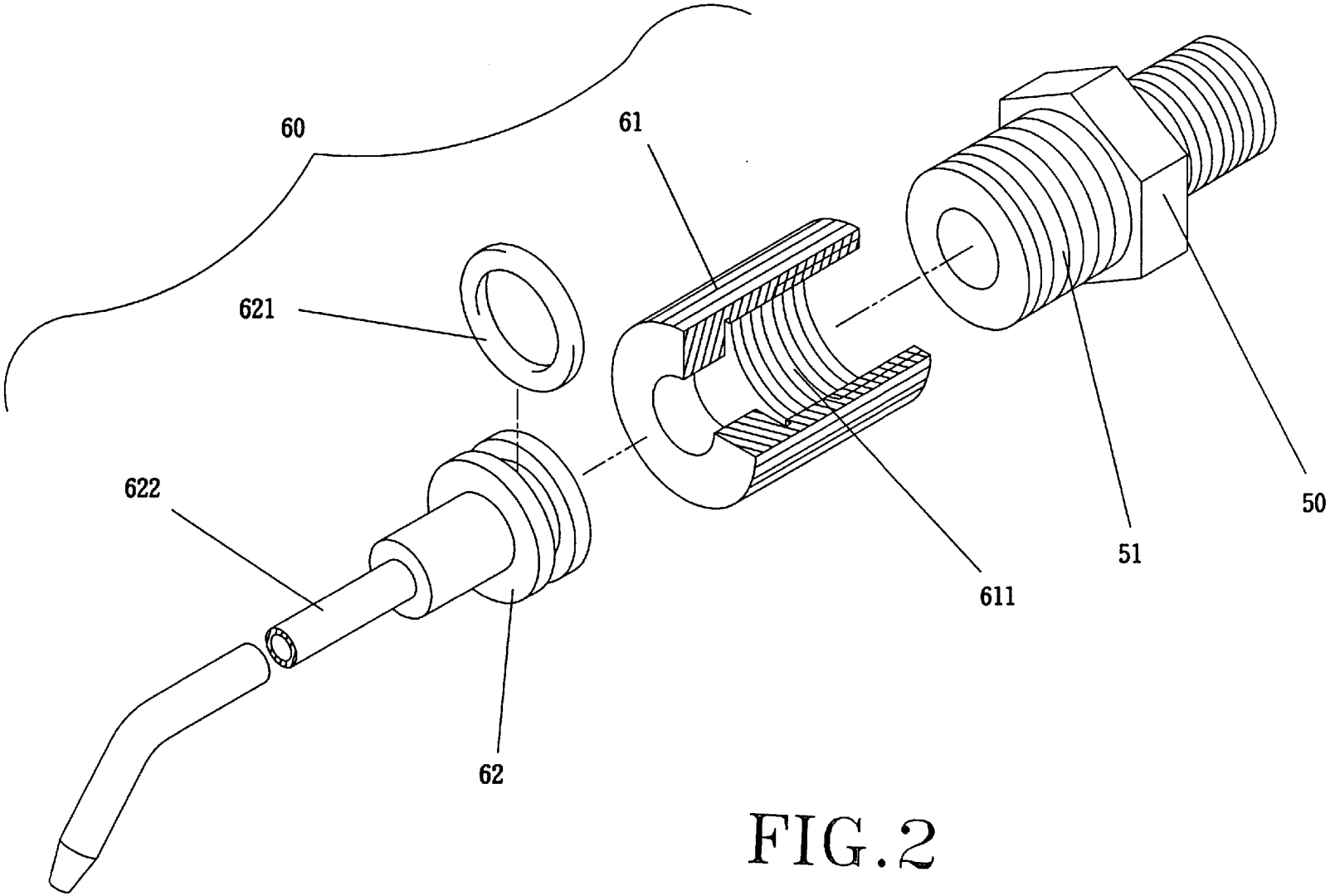
FIG. 2 is an exploded view showing the blasting adapter of the present invention.
Figure 3:
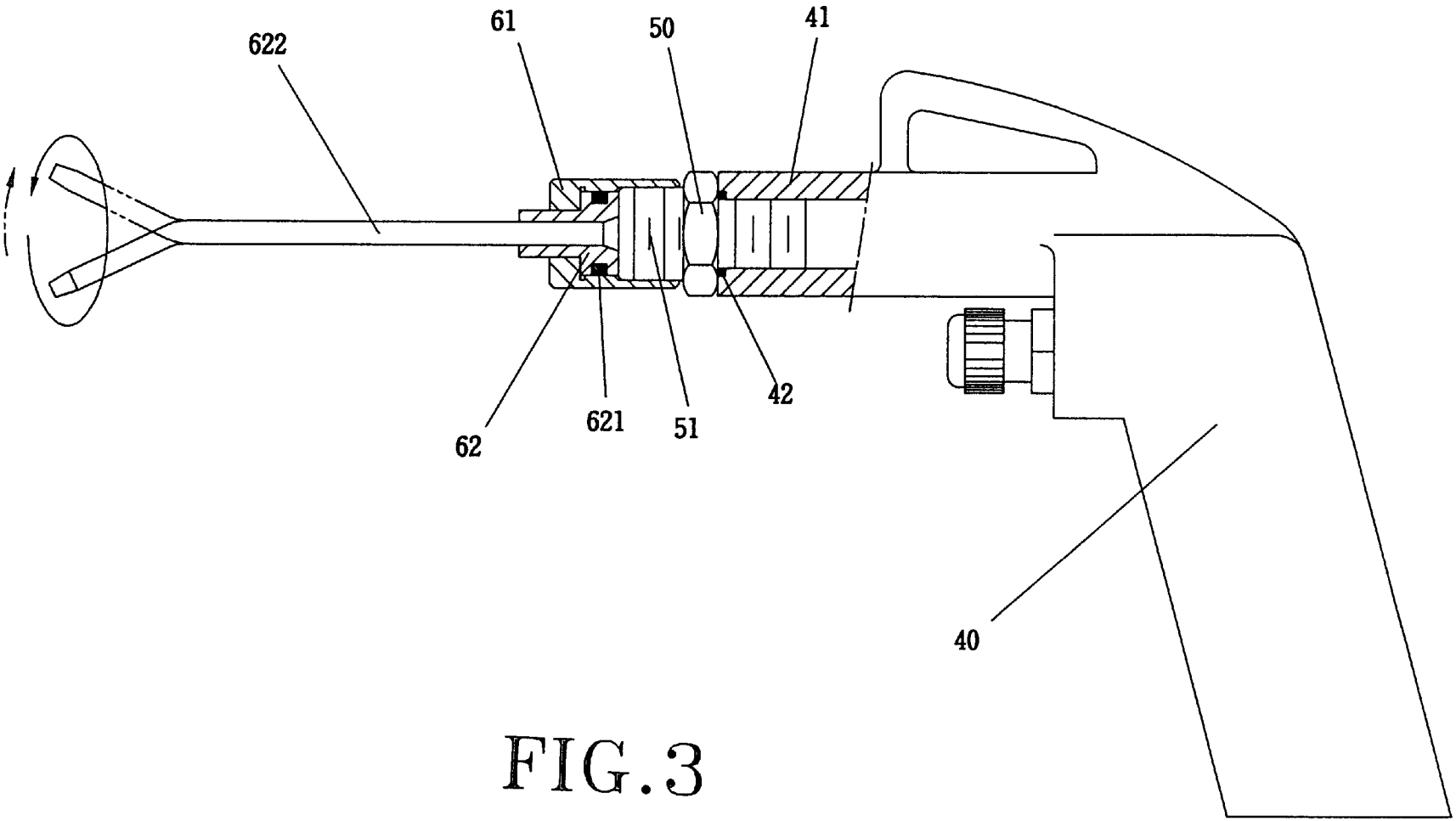
FIG. 3 is a cross-section view showing assembling with the blasting adapter of the present invention.
Figure 4:
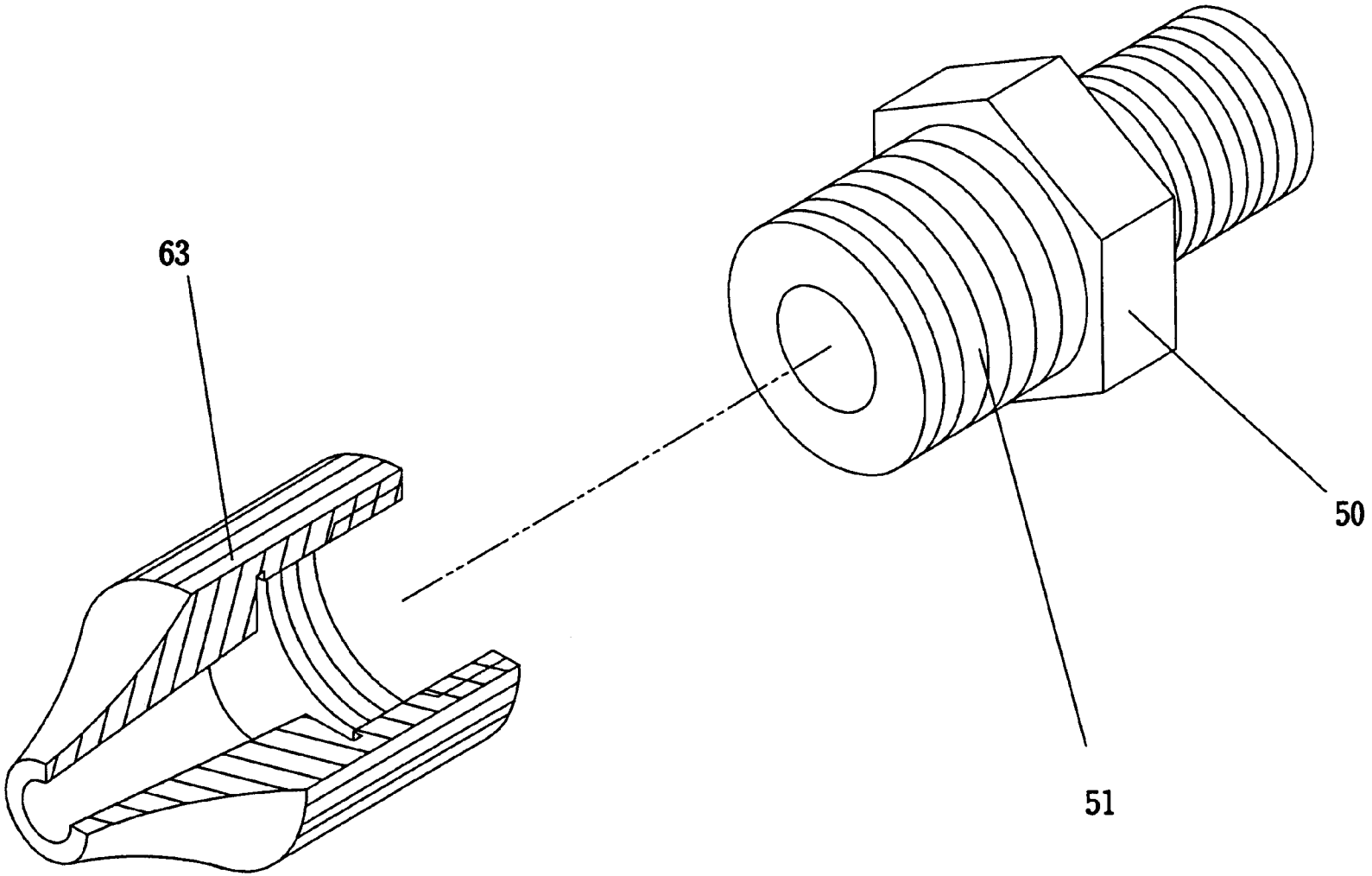
FIG. 4 is an exploded view showing the short blasting adapter of the present invention.
Figure 5:
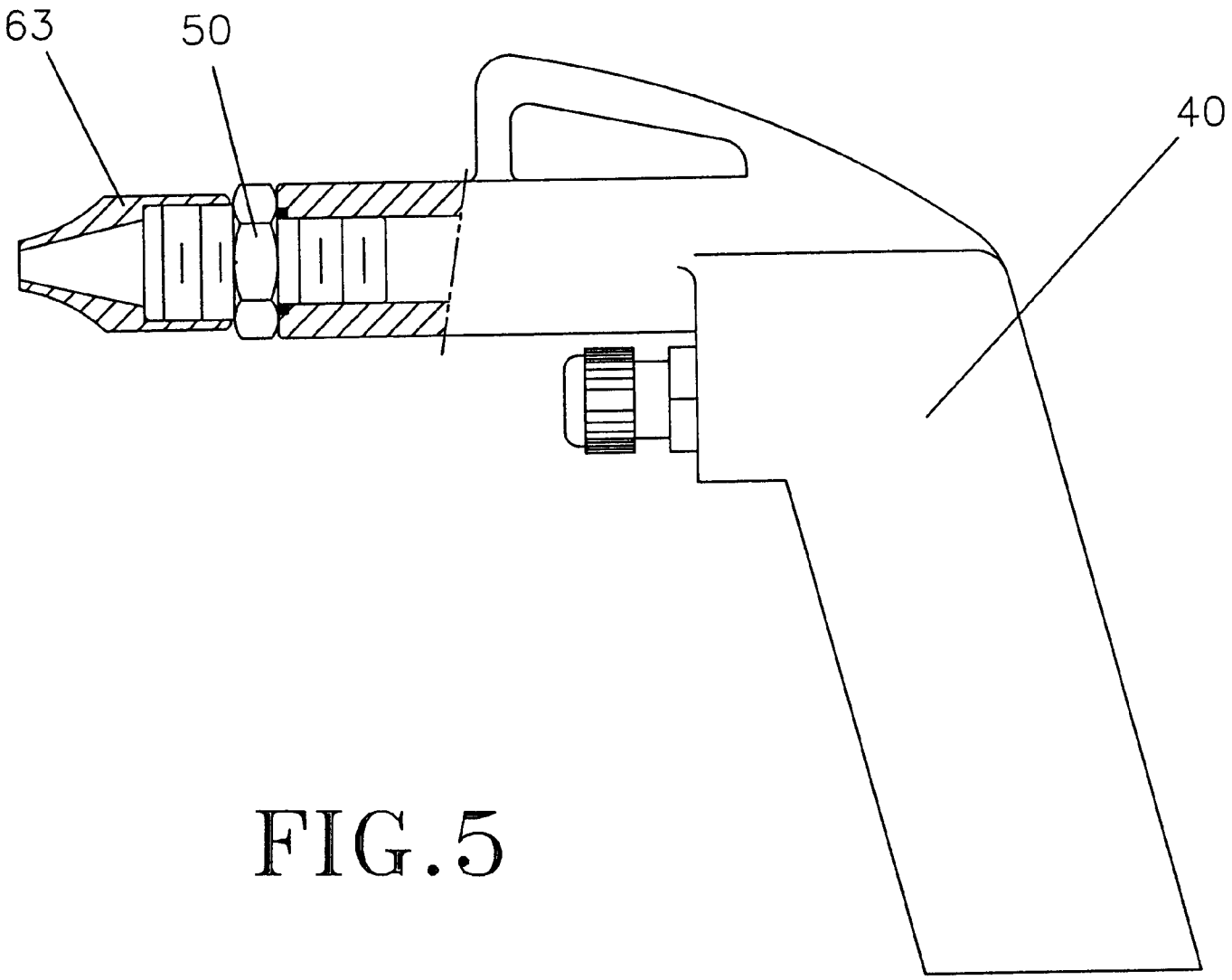
FIG. 5 is a cross-section view showing assembling with the short blasting adapter of the present invention.

Referring to FIG. 1, the present invention provides a blast gun 40, in which the inside of the blowpipe 41 is built up with thread for securing a versatile adapter 50 on with an O-ring 42 between of them so as to seal the connection portion. The another end of the versatile adapter 50 is a thread portion 51 for securing with a blast adapter 60 (shown as FIG. 2), or an inflating adapter 70(shown as FIG. 6), or a spraying adapter 80 (shown as FIG. 9) and so on to combine a blast gun, an inflating gun, a painting gun or a cleaning gun to meet various purposes. Wherein:

The blast adapter 60, referring to FIG. 2 and FIG. 3, includes a free splicing sleeve 61 with a female thread 611 at the inside for securing on the thread portion 51 of the versatile adapter 50, and a blasting nozzle comprising a fitting 62 installing into the free splicing sleeve 61 with an O-ring 621 putting on the outside of the fitting 62, and a blowpipe 622 extending front the front end of the fitting 62 with a certain length. Said free splicing sleeve 61 has an anti-slip fringed outside surface for the convenience of securing on or loosing out rapidly. Said versatile adapter 50 can be connected with a short blasting nozzle 63 in screwing connection also, as shown on FIG. 4 and FIG. 5.

Figure 6:
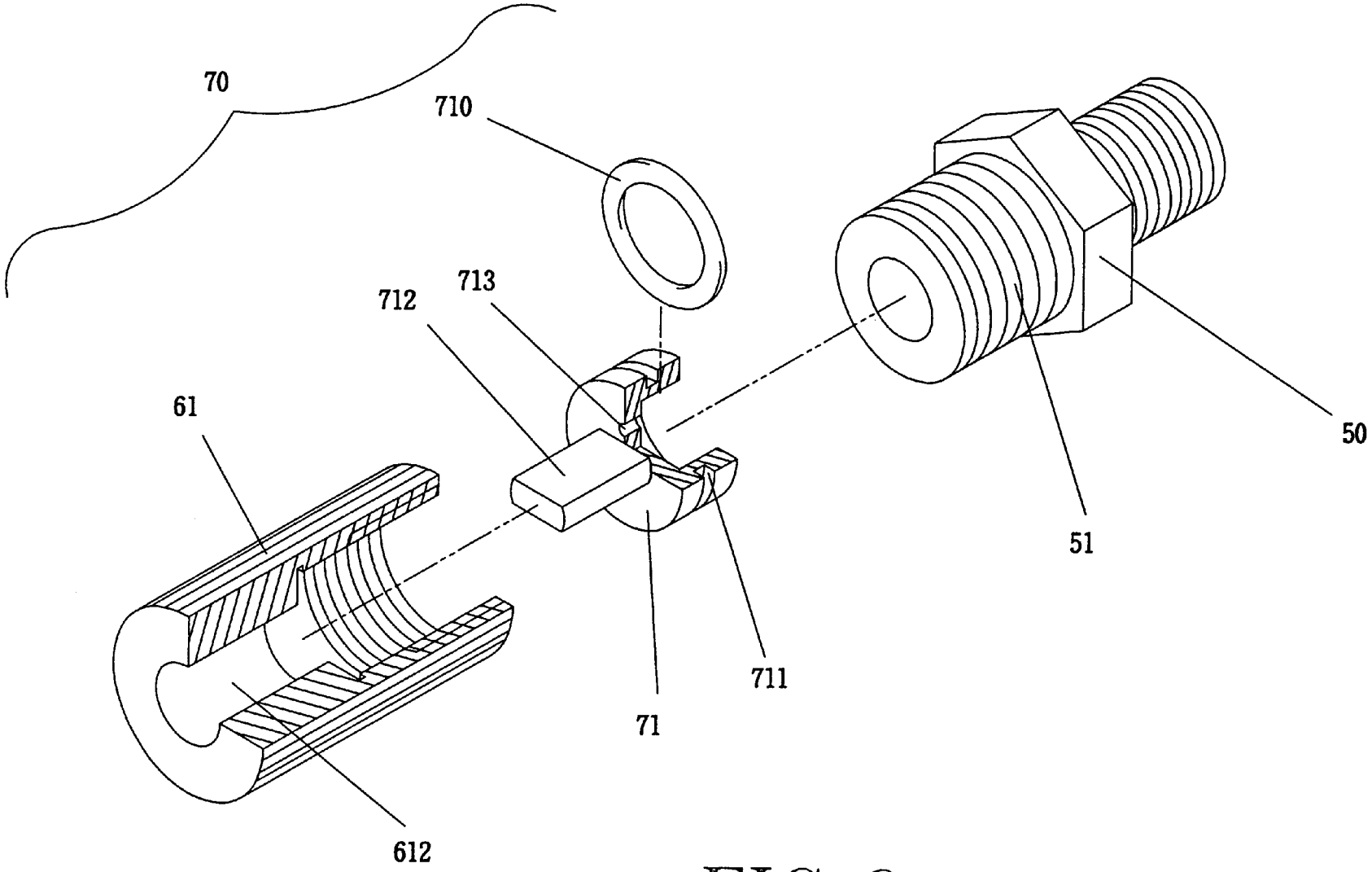
FIG. 6 is an exploded view showing the inflating adapter of the present invention.
Figure 7:
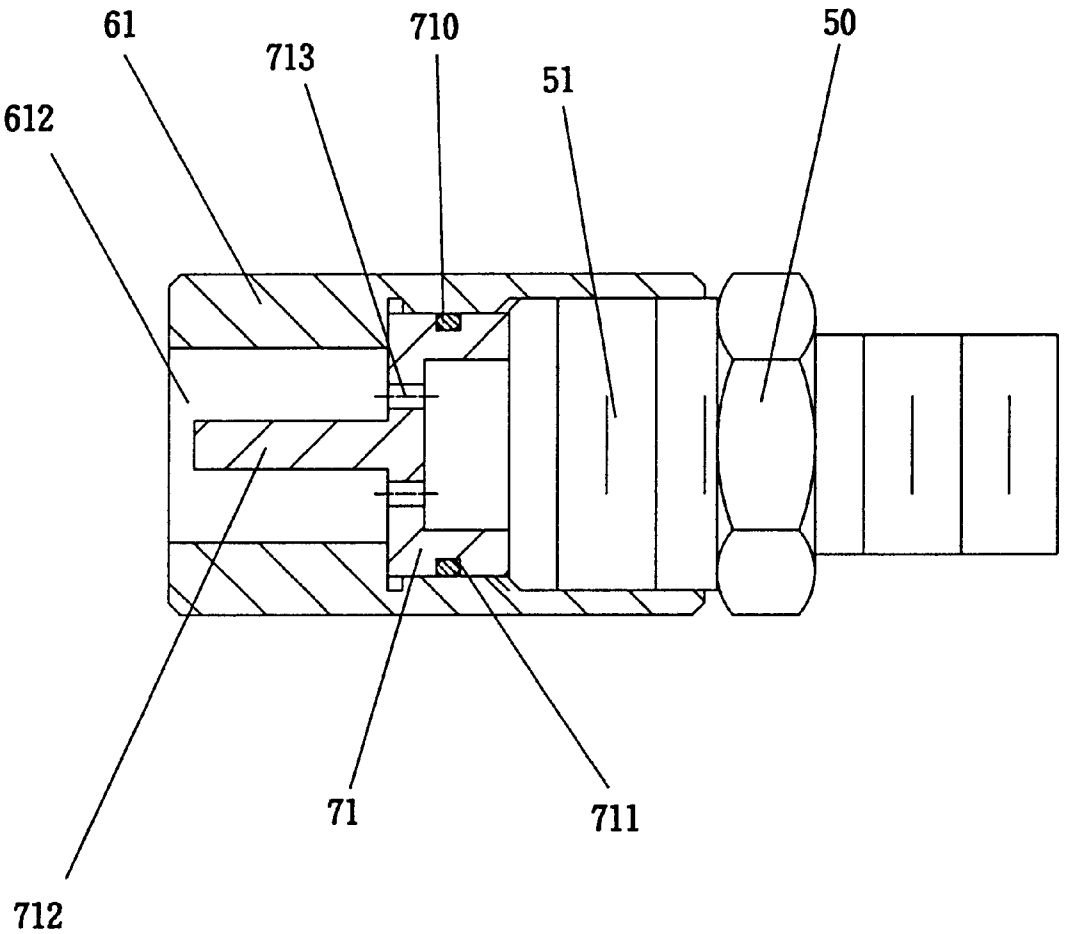
FIG. 7 is a cross-section view showing the inflating adapter of the present invention.
Figure 8:
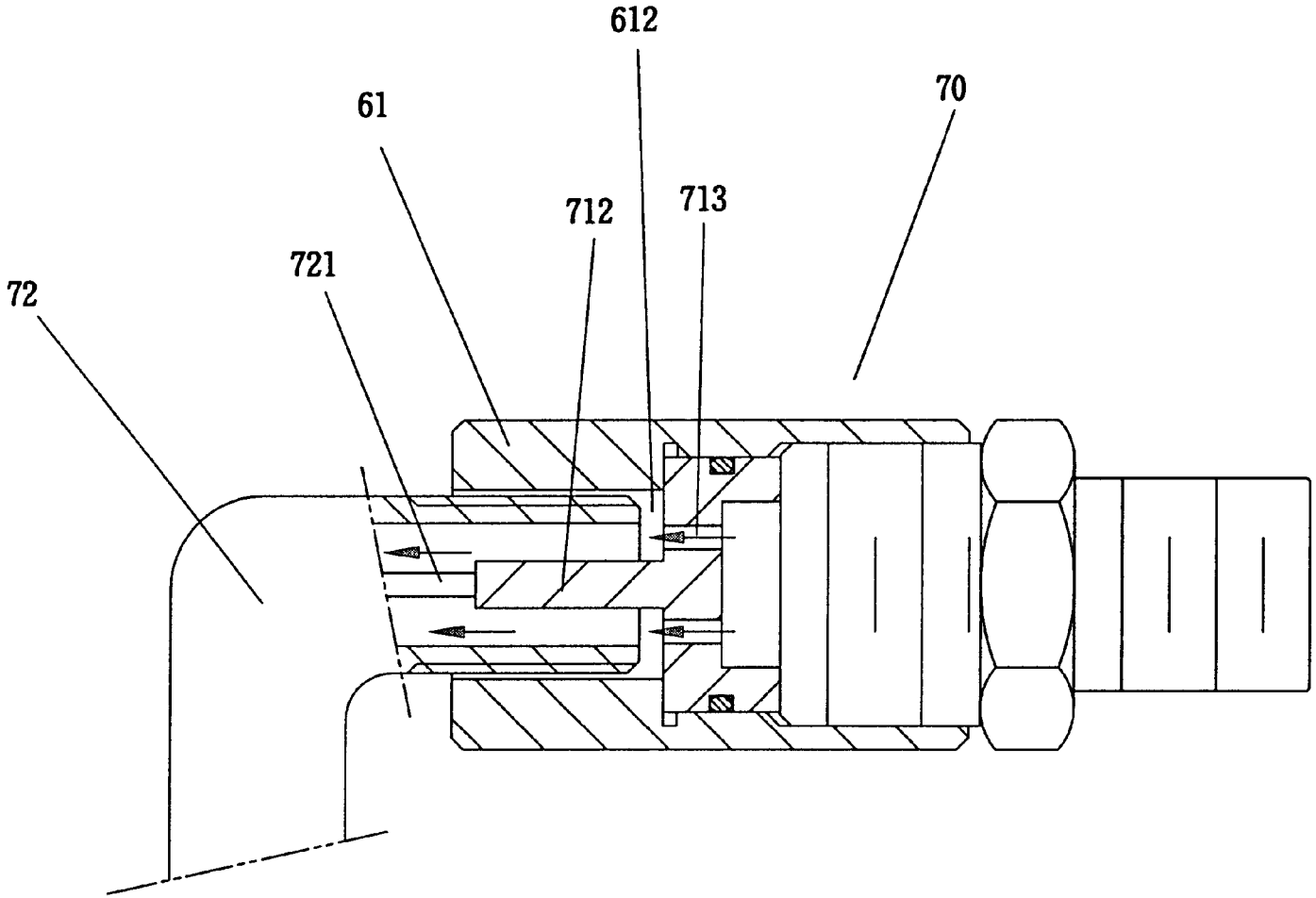
FIG. 8 is a cross-section view showing an operation of the inflating adapter of the present invention.

The inflating adapter 70, referring to FIG. 6 , FIG. 7 and FIG. 8, employs an inflating fitting instead of said blasting nozzle. Said inflating fitting 71 has a ring groove 711 built upon the outside surface for embedding an O-ring 710 in, and a nose-spike 712 extending out at the front end and taling the shape of a flat stripe. Beside the nose-spike 712, the inflating fitting 71 has several axial air holes 713 built on the front end for the compressed air passing through. Said inflating fitting 71 is installed into the inside of the free splicing sleeve 61, then the free splicing sleeve 61 is secured on the thread portion 51 of the versatile adapter 50 so that the nose-spike 712 stretches into the front opening 612 of the free splicing sleeve 61, and slides at the inside of the free splicing sleeve 61 axially.

Figure 9:
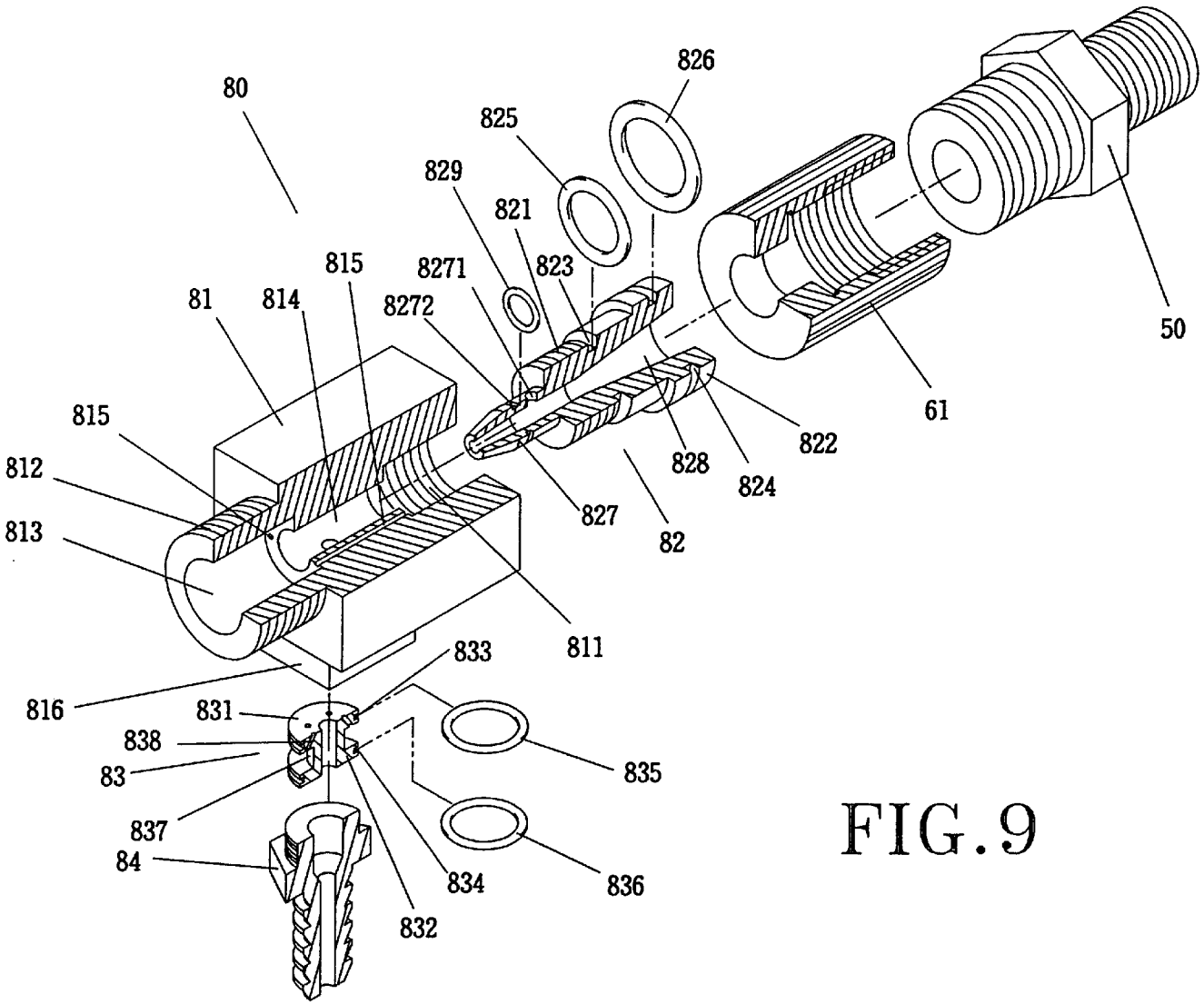
FIG. 9 is an exploded view showing the spraying adapter of the present invention.
Figure 10:
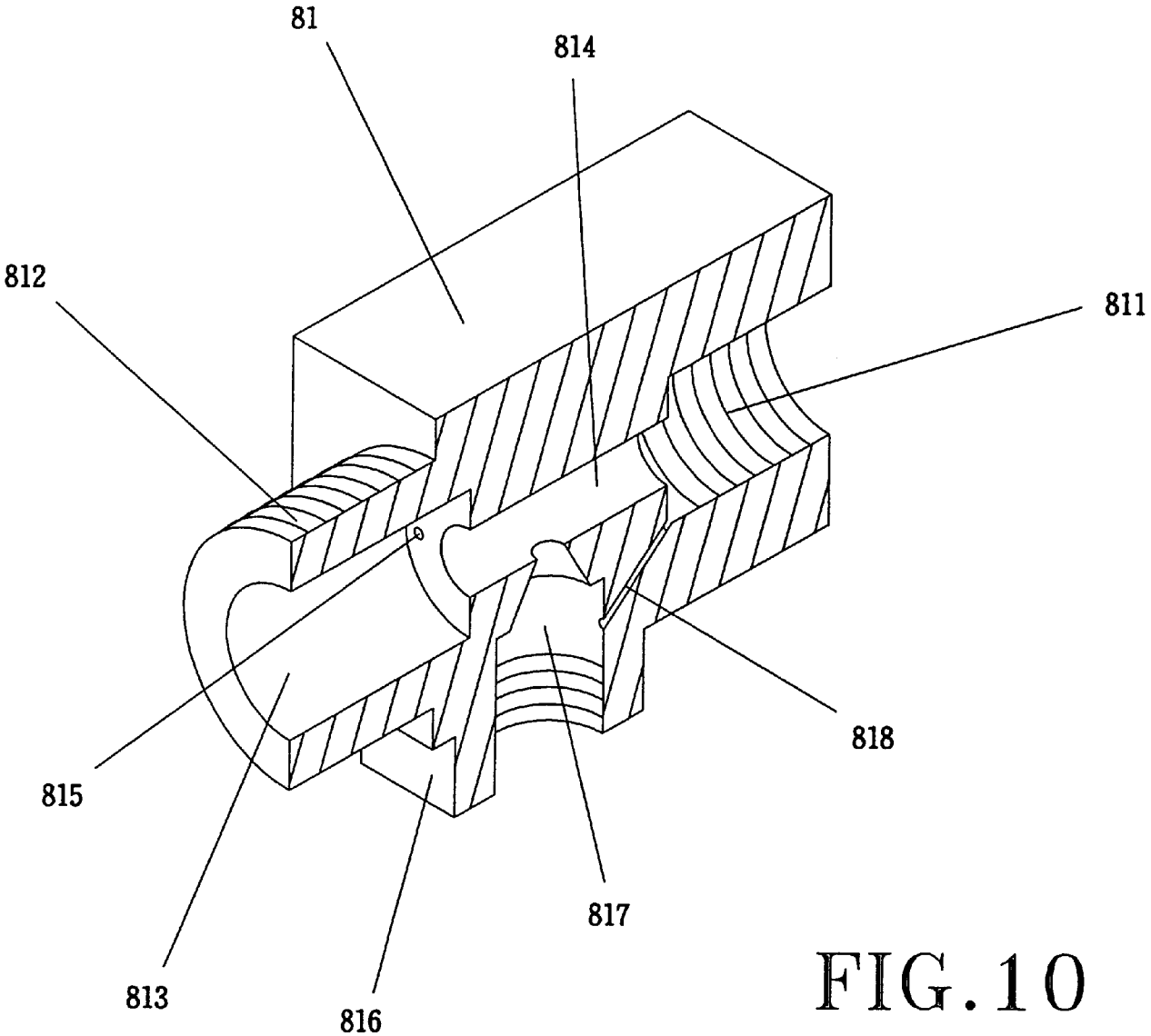
FIG. 10 is a cross solid view showing the spraying adapter of the present invention.
Figure 11:
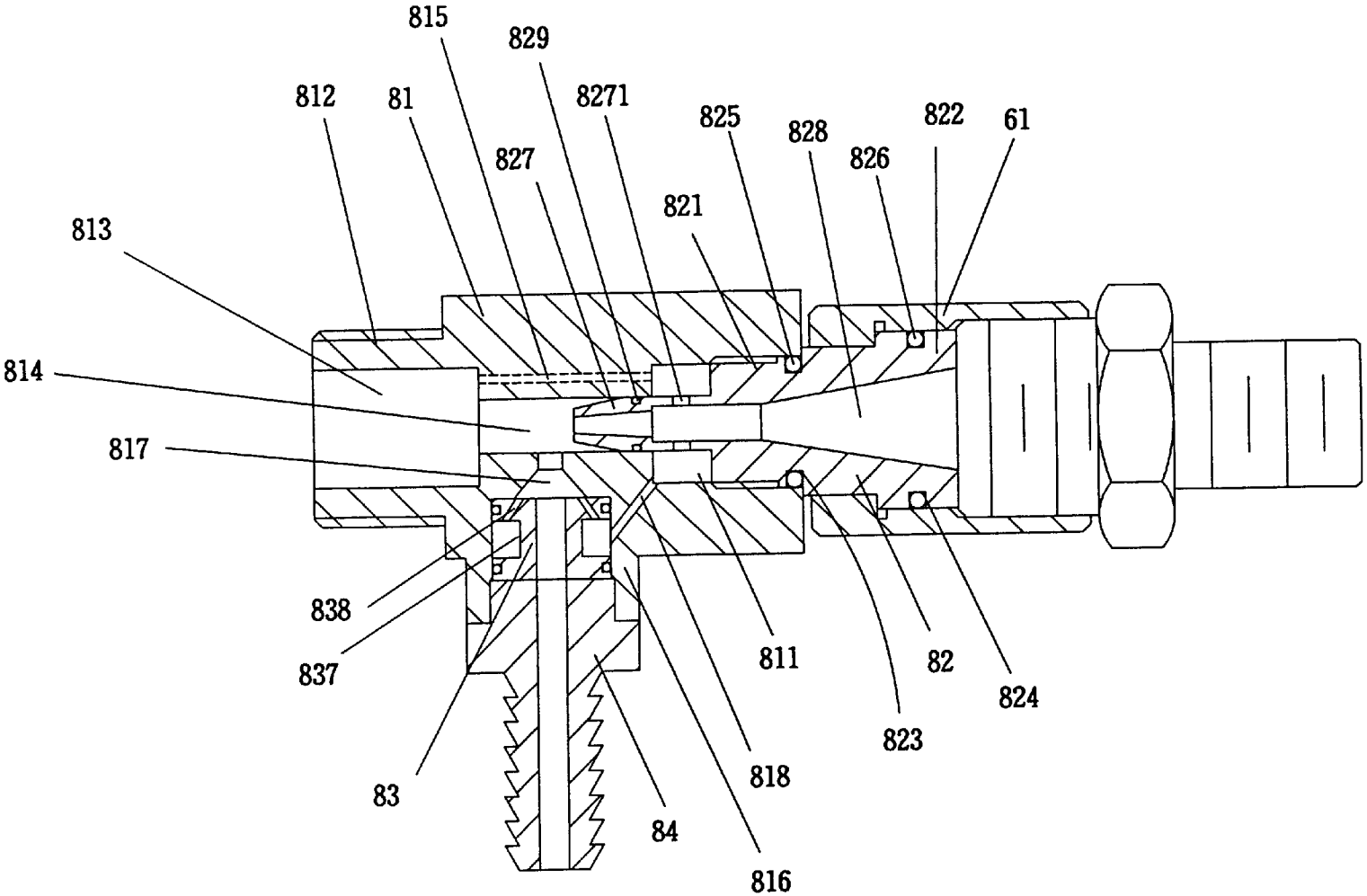
FIG. 11 is a cross-section view showing assembling with spraying adapter of the present invention.

The spraying adapter 80, referring to FIG. 9, FIG. 10 and FIG. 11, includes a nozzle carrier 81, a nozzle valve 82, a fitting valve 83, a pipe connection 84 and several O-rings. Wherein said nozzle carrier 81 has a threaded hole 811 at one end for screwing on the nozzle valve 82, and a nipple 812 with a front end hole 813 at another end, and a jet exhaust 814 connecting the front end hole 813 to the threaded hole 811, and a pair of diversion holes 815 built on the side of the jet exhaust 814, and an extending manifold 816 with a housing hole 817 built on the bottom side of the jet exhaust 814 and a cone hole connecting the housing hole 817 to the jet exhaust 814; said housing hole 817 is used for housing a fitting valve 83, and the pipe connection 84 is secured on the bottom end of the housing hole 817; a bevelled diversion hole 818 is built upon the nozzle carrier 81 connecting the threaded hole 811 to the housing hole 817, as shown on FIG. 10, so that the compressed air can enter the housing hole 817. The fitting valve 83 has two flanges 831 and 832 respectively at both ends, on which there is a ring groove 833 834 for embedding O-ring 835, 836 in respectively; between the two flange 831 and 832, a ring dent 837 coordinating to the diversion hole 818, on the upper flange 831 there are several bevel holes 838 drilled connecting the top surface to the ring dent 837 so as to lead the compressed air from the ring dent 837 into the housing hole 817. Said nozzle valve 82 securing into the threaded hole 811 appears to a coupled rod—consisting of a nozzle section 827, a threaded portion 821, a round section and rear-end fitting section 822 arranged from the front to rear sequentially. There are two ring grooves 823 and 824 built upon the root of the threaded portion 821 and the outside wall of the fitting section 822 respectively for embedding two O-rings 825 and 826 therein. Said nozzle section 827 is made in the shape of a cone. A through hole 828 is formed in the nozzle valve 82 from the front tip to the rear end of the nozzle valve 82. Co-ordinating to the threaded hole 811, a pair of side-wind holes 827 are built in the nozzle section 827. On the root of the nozzle section 827 extending into the jet exhaust 814, a ring groove 8272 is formed for putting an O-ring 829 on. Said fitting section 822 is located in the free splicing sleeve 61, and fixed on the front end of the versatile adapter 50 so as to mount on the air fountain 40 to assemble a, spray gun with a high absorbing force spraying adapter 80.

Figure 14:
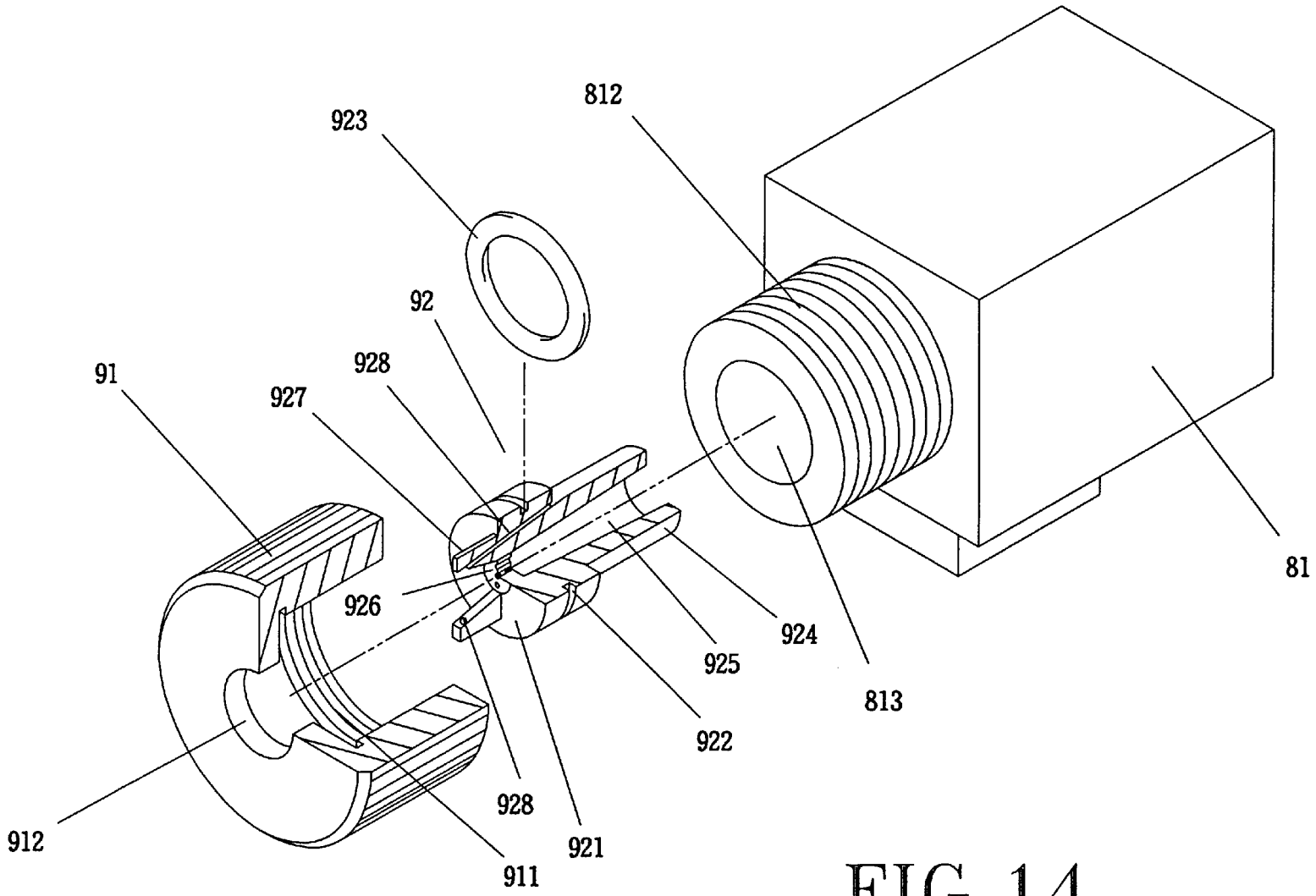
FIG. 14 is an exploded view showing the painting adapter of the present invention.
Figure 15:
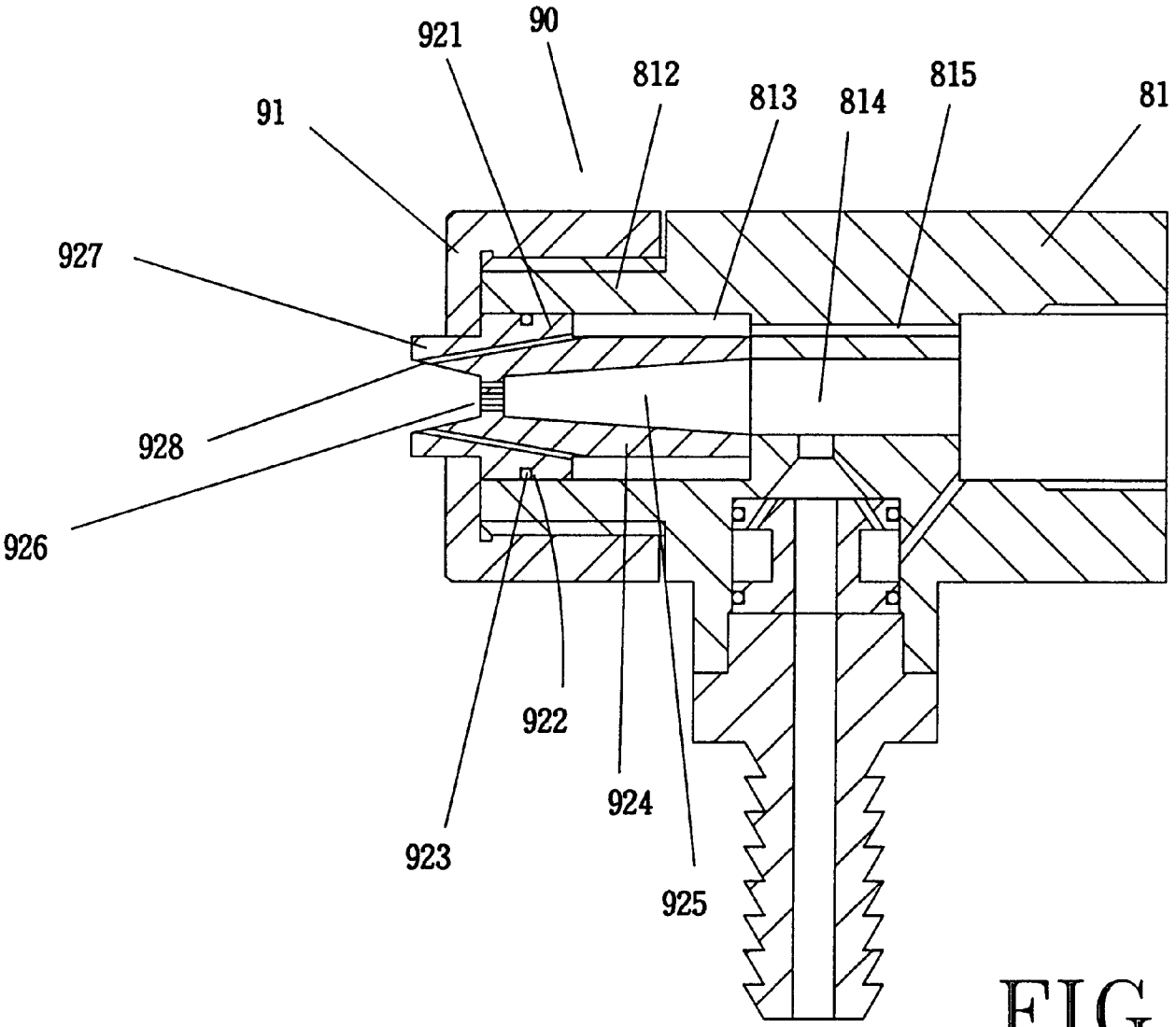
FIG. 15 is a cross view showing the combined painting adapter of the present invention.

A The painting adapter 90, as shown on FIG. 14 and FIG. 15, comprises an end socket ring 91 and a painting valve 92. Wherein said end socket ring 91 has a threaded hole 911 for housing the painting valve 92, and securing on the nipple 812 of the nozzle carrier 81. On the cylinder 921 of the painting valve 92, there is a ring groove 922 built on for embedding an O-ring 923 is An extension tube extends from the rear end of the cylinder 921 for fitting into the front-end hole 813 of the nozzle carrier 81. A blind hole 925 is drilled on the extension tube 924, and on the blind end there are many through pinholes 926 penetrating the front end of the cylinder 921, and there are two opposite flat fins 927 formed on the front end of the cylinder 921 between the through pinholes 926 axially. And there are two bevelled holes 928 drilled on the cylinder 921 from the inside slants of the flat fins 927 to the root of the extension tube 924 for leading out the compressed air jetted from the front-end hole 813 of the nozzle carrier 81.

According to above, attaching different accessory meets various purposes in practising operation. The detail description is as follows:

1. Working as a common blasting gun:
   (1) Exchange the long and the short blowpipes: referring to FIG. 4 and FIG. 5, the air fountain 40 attaches with the short blast nozzle 63 secured on the versatile adapter 50 to assemble a blasting gun. For meeting a narrow long working site, screw out the short blast nozzle 63 from the versatile adapter 50; replace the short blast nozzle 63 by a longer blowpipe 622, referring to FIG. 2 and FIG. 3, by the free splicing sleeve 61, the longer blowpipe 62 is located on the head of the versatile adapter 50 with the rear end fitting 62 rapidly and easily.
   (2) Orientating the direction of the outlet of the blowpipe freely: as fixing the fitting 62 with the free splicing sleeve 61, by screwing in the free splicing sleeve 61, the back side of the fitting 62 is pressed on the head end of the thread portion 51 of the versatile adapter 50. When reorienting the direction of the blowpipe 622, loose the free splicing sleeve 61 so as to free, and to turn the blowpipe 622 so that the outlet directs to the desired orientation, then secure the free splicing sleeve 61 on again for meeting operating in a lower narrow, place.

2. working as an inflating gun:

Referring to FIG. 6, FIG. 7 and FIG. 8, as trying to inflate a tire, replace the jet adapter with the inflating adapter 70 on the versatile adapter 50 so that the air valve 72 of the tire stretches into the front end hole 612 of the free splicing sleeve 61 to make the nose-spike 712 to press the valve stem 721 of the air valve 72 back, in order to open the air valve of the tire, as pressing the trigger button so that the compressed air is led into the tire.

In the garage, the workers can work with a blasting gun and an inflating with only one air fountain without replacing any accessory.

3. working as a painting gun:

Referring to FIG. 9, FIG. 10 and FIG. 11, the spray adapter 80 provided by the present invention can be located on the head end of the versatile adapter 50 by the free splicing sleeve 61, thereby generate a great suction force in the housing hole 817 of the manifold 816 as the compressed air passing through the spray adapter 80, at the same time some compressed air is led into the fitting valve 83 via a by-passing diversion hole 818, then through the bevel holes 838 enters the housing hole 817 to intense the absorbing force of the housing hole 817.

Figure 12:
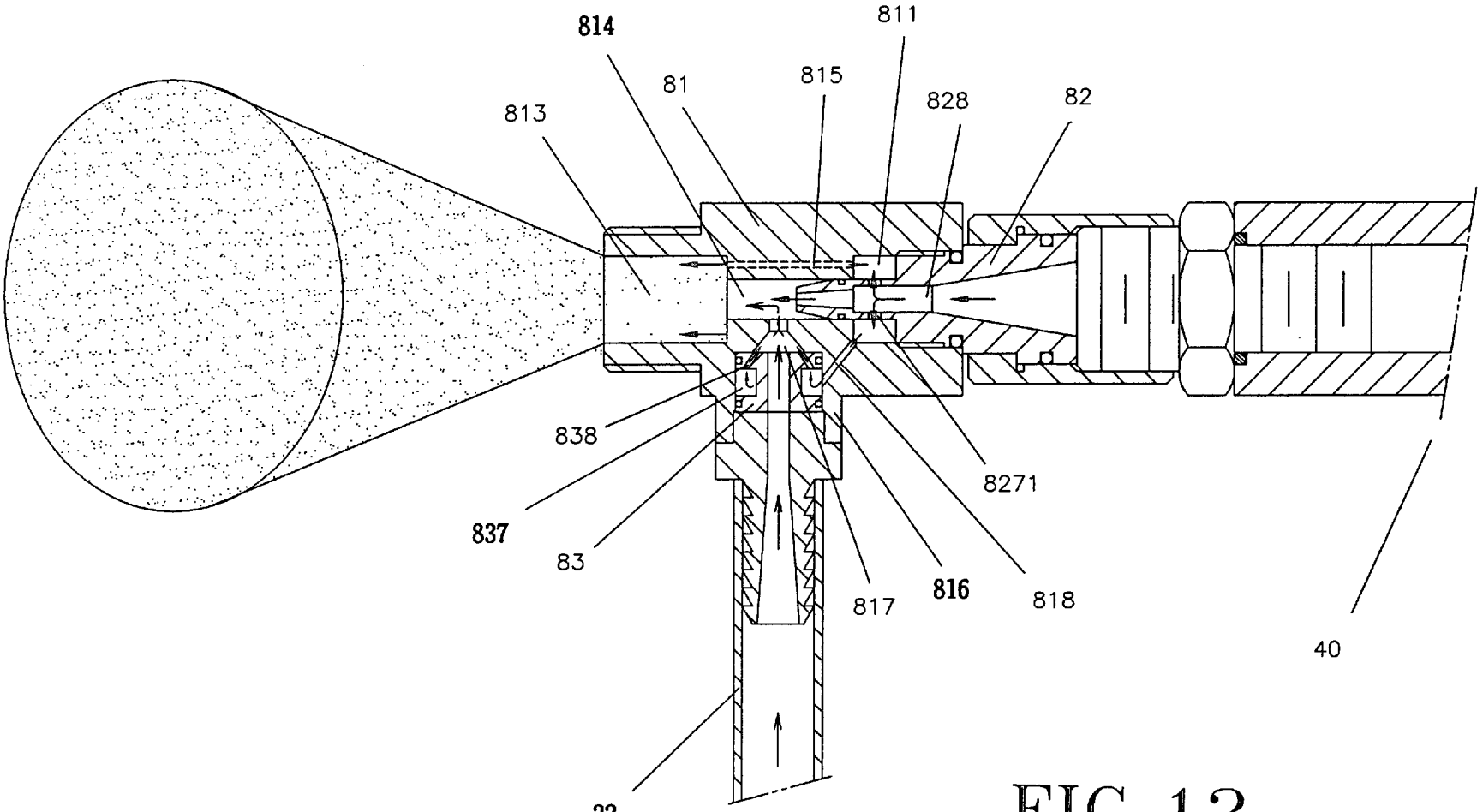
FIG. 12 is a cross-section view showing an operation of the spraying adapter for spraying paint of the present invention.

(1) spraying priming paint operation:

Referring to FIG. 12, the compressed air is led into the jet exhaust 814 of the nozzle carrier 81 via the nozzle hole 828 of the nozzle valve 82, and jets out from the front end hole 813, meanwhile generating a suction force in the housing hole 817 of the manifold 816, adding some compressed air enter the inner threaded hole 811 via the side-wind holes 8271 on the nozzle section 827 of the nozzle valve 82, then some flows into the front end hole 813 through the diversion holes 815; and some is led into the ring dent 837 of the fitting valve 83 via the bevel diversion hole 818, then enters the housing hole 817 through the bevel nozzle holes 838, and mixes with the absorbed paint, then flow into the jet exhaust 814, thereby intense the suction force several times, hence the length of the hose 22 can be claimed longer than the conventional to get the bottom of the priming paint can to absorb the paint up to be atomised, and mixes with the air led in via the diversion holes 815 for reducing the pressure and the flowing speed, then be jetted out from the front end hole 813 to form a radial cone fog mixture current with a round stick range.

Figure 13:
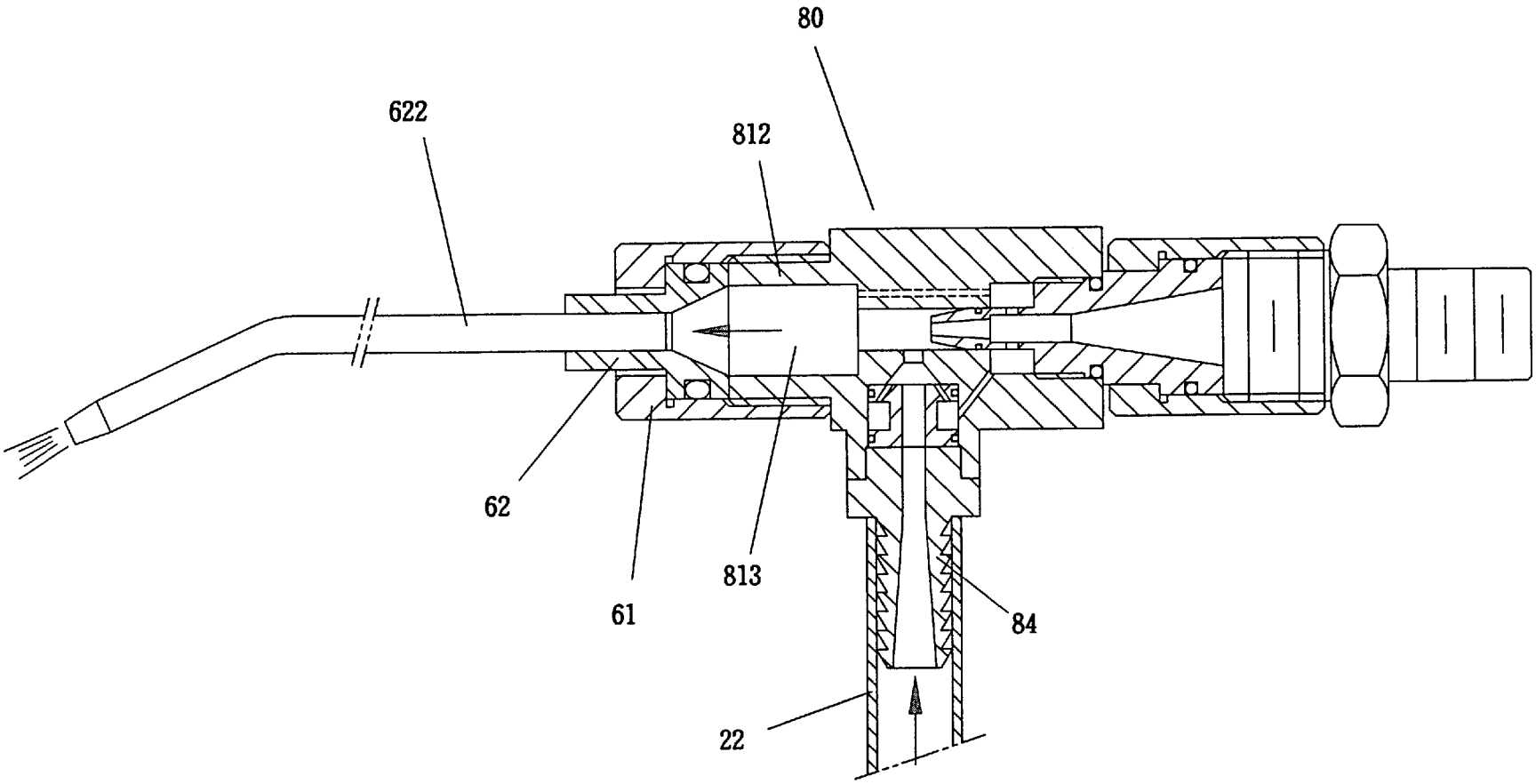
FIG. 13 is a cross-section view showing an operation of the spraying adapter for jetting toluene to wash of the present invention.

(2) spraying cleaning operation:

Referring to FIG. 13, attach a blowpipe on the nipple 812 of the spray adapter 80 with the fitting 62 by the free splicing sleeve 61 in screw connection to assemble a high speed jet cleaning gun. Wherein the toluene in the tank is absorbed into front end hole 813 and mixed by the high speed jetting current and assistant jetting current to form a high pressure air and liquid mixed current, to be jetted out through the outlet of the blowpipe 622 to improve the clean effect greatly, and the hose 22 can be demanded longer, so the operation range of the worker is increased efficiently.

Figure 16:
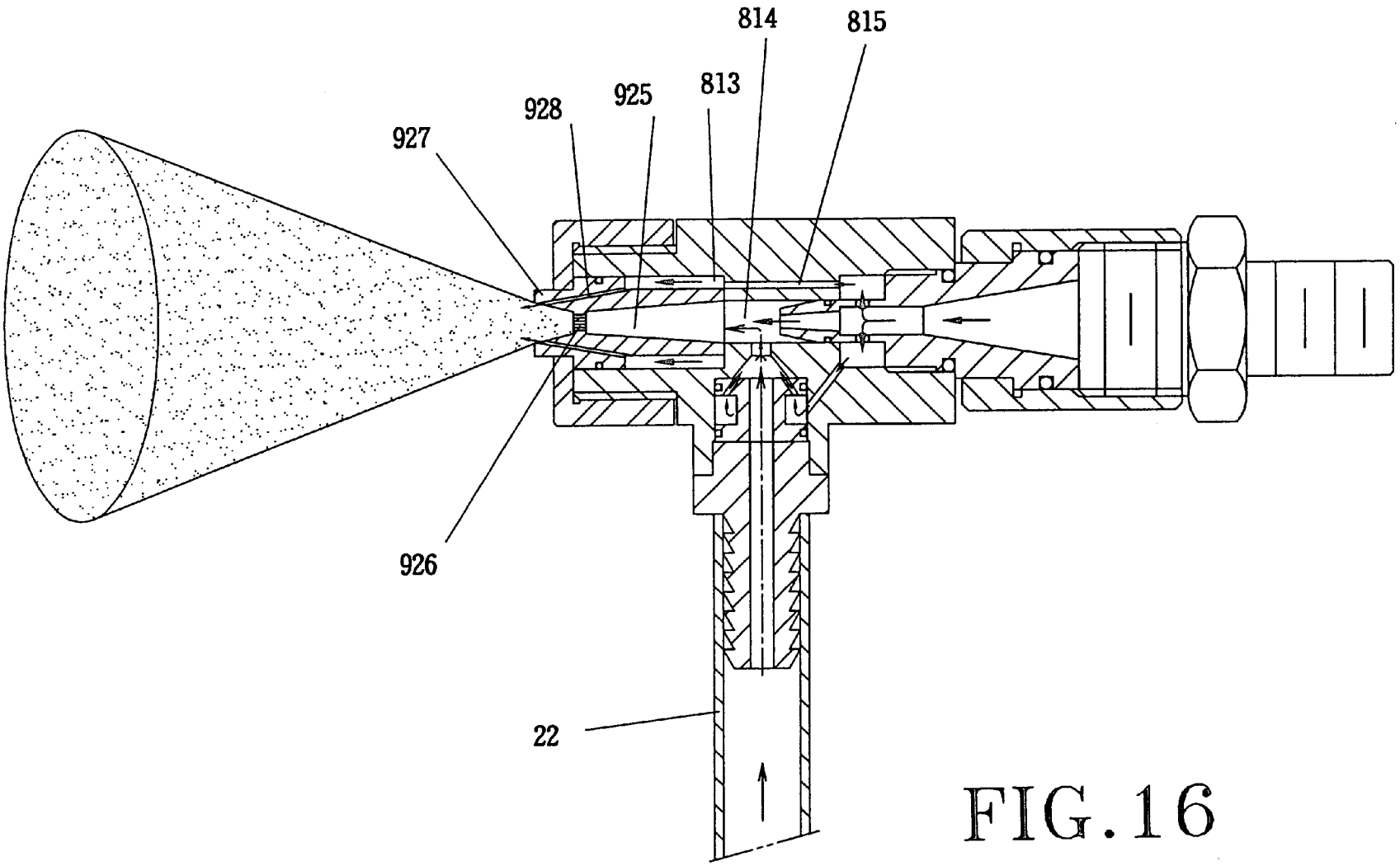
FIG. 16 is a cross view showing an operation of the painting adapter of the present invention.

(3) spraying paint operation:

Because the stick range of the sprayed paint is claimed into an oval difference with spraying priming paint, therefore for meeting this goal, install the painting adapter 90 on the spraying adapter 80 to assemble a painting gun, as shown on FIG. 14, FIG. 15 and FIG. 16, by securing the painting adapter 90 on the nipple 812. The compressed air mixes with the pumped paint in the jet exhaust 814 and the blind hole 925, then is atomised as passing through the jet pin-holes 926; on the other way, some compressed air is led into the front end hole 813 by the diversion hole 815, then via two bevel holes 928 on the two fins 927 of the cylinder 921 the compressed air is jetted out to run into the atomised paint so that the rate of the air current is changed, therefore the horn shape of the jetting paint is changed too to have an oval stick range, thereby carry out a common painting operation. On the other hand, as the painting valve 92 is located by the end socket ring 91, the rear end of the extension tube 924 is pressed against the rear end of the front end hole 813. As trying to change the jet orient of the painting adapter 90, loose the end socket ring 91 to free the painting valve 92, then turn it to the desired direction, secure the end socket ring 91 on again.

Figure 17:
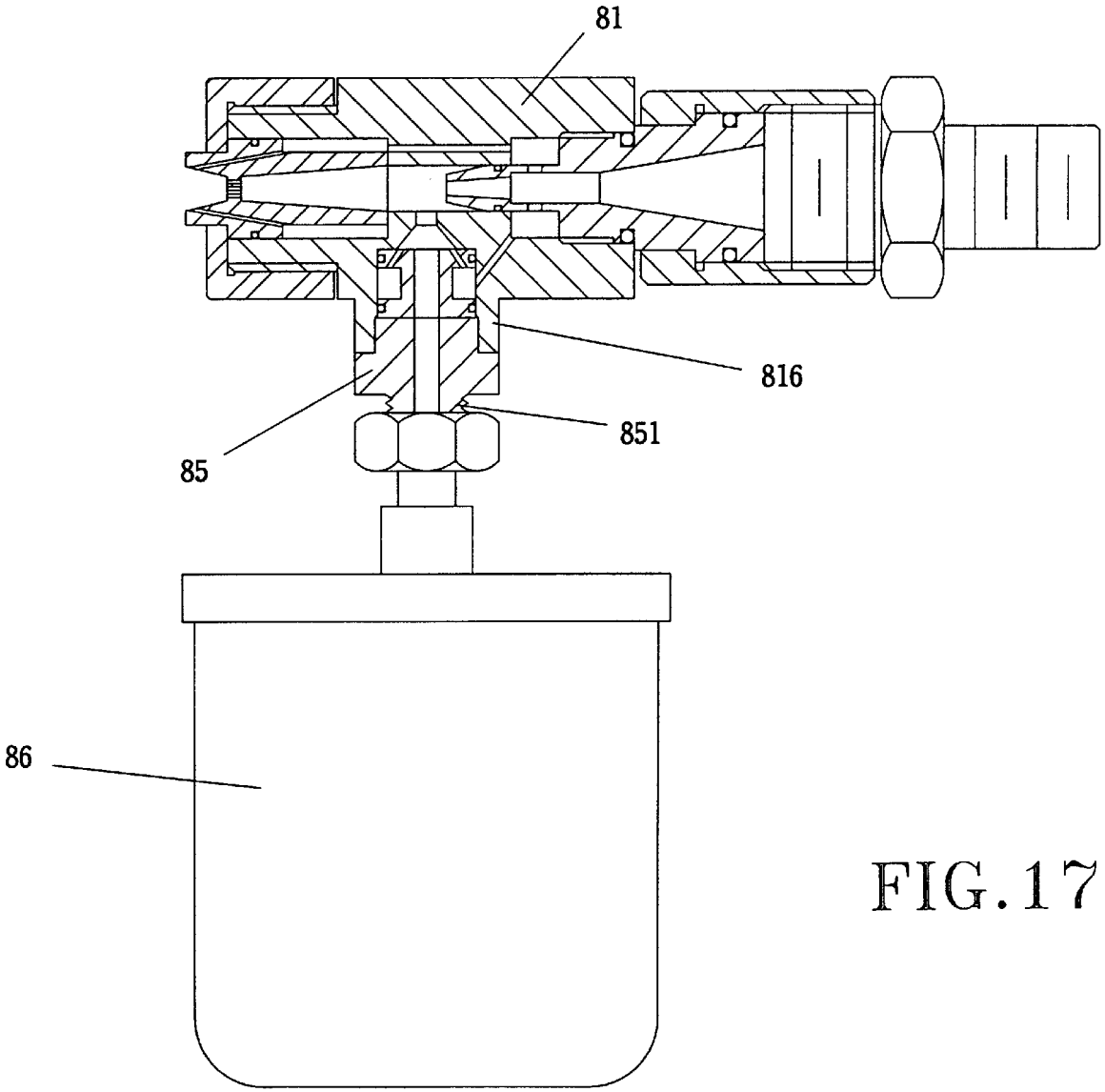
FIG. 17 is a cross view showing the painting adapter with a paint can of the present invention.
Figure 18:
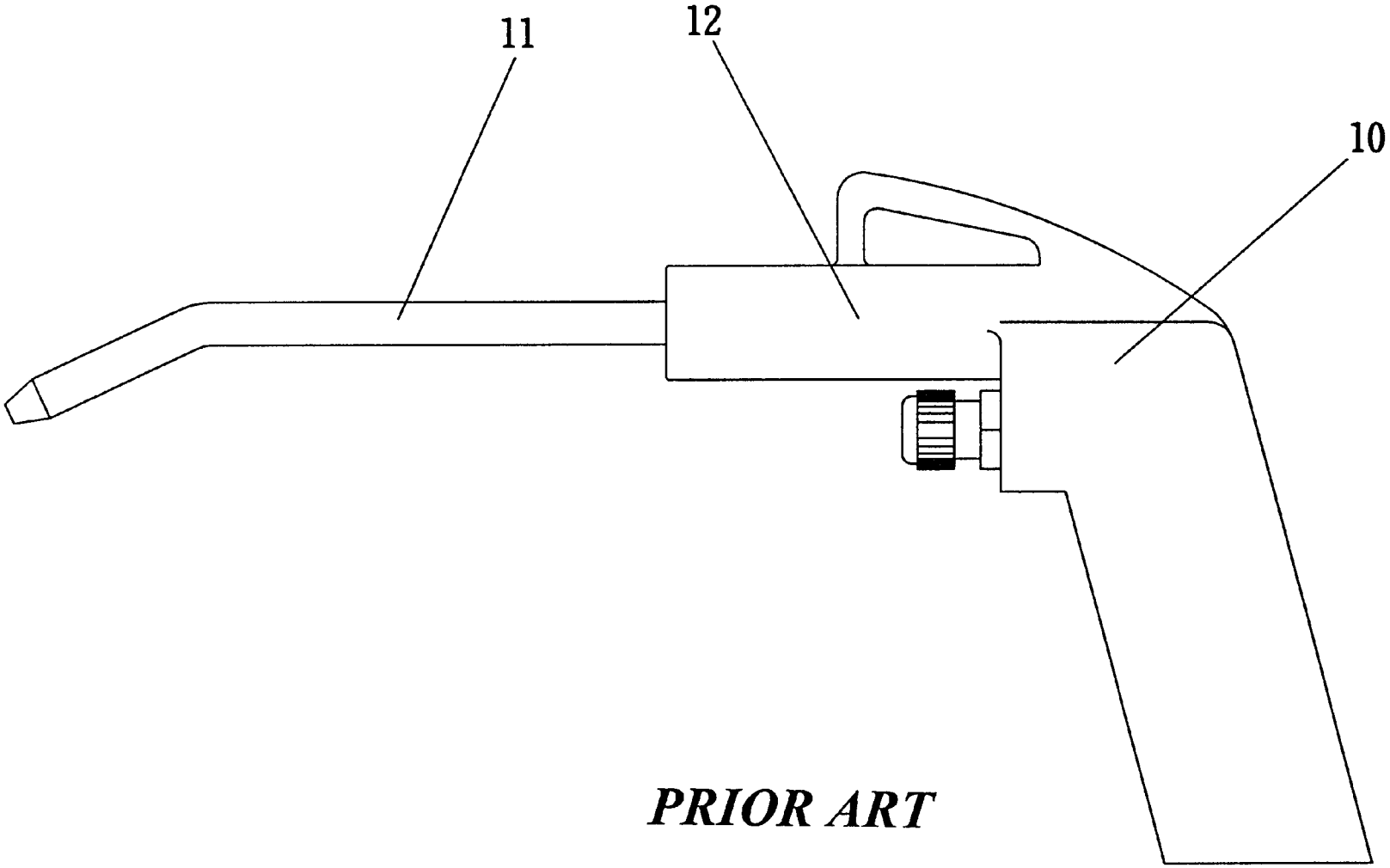
PRIOR ART FIG. 18
FIG. 18 is side view of a conventional blast gun.
Figure 19:
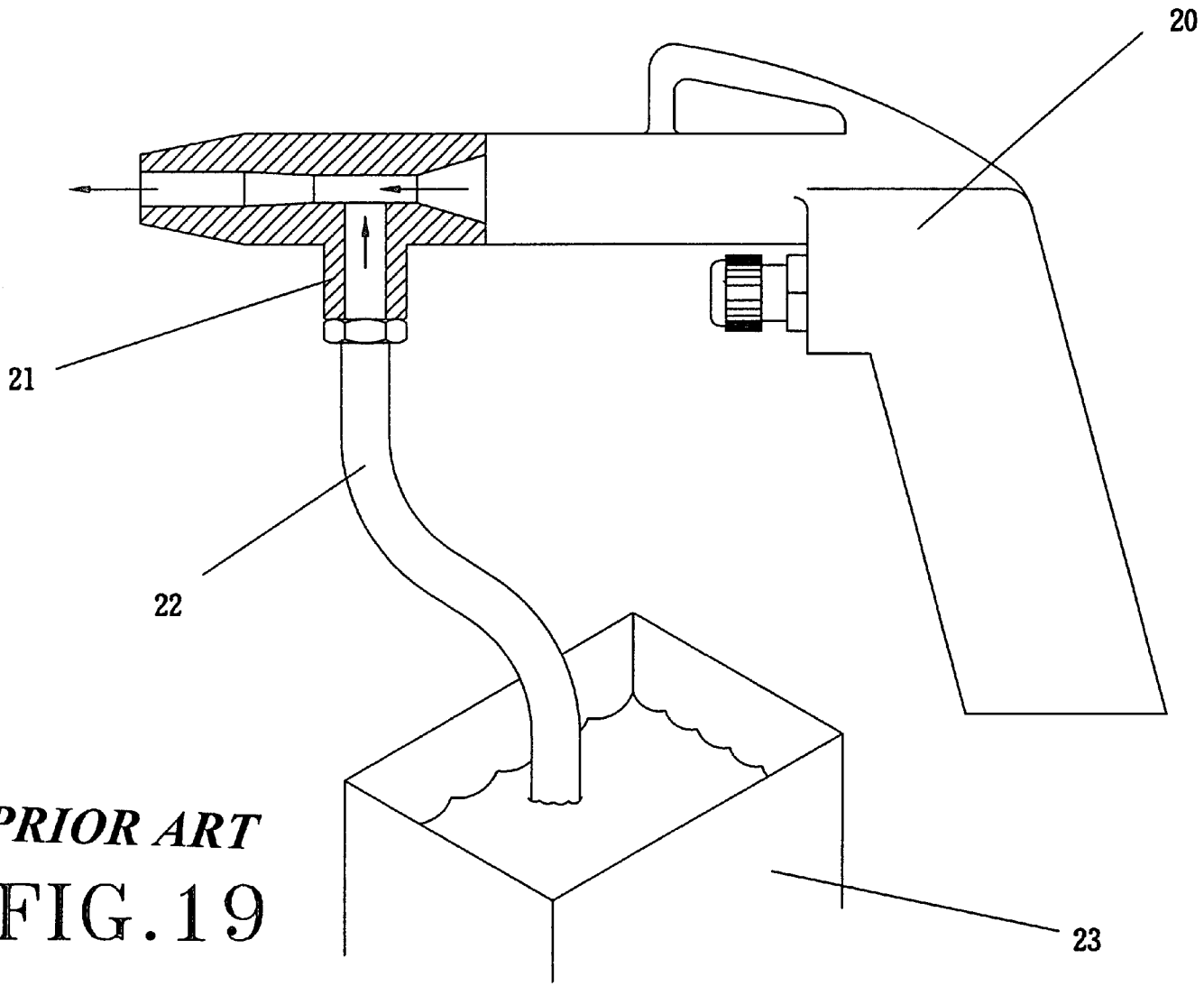
PRIOR ART FIG. 19
FIG. 19 is a schematic drawing of the conventional cleaning gun.
Figure 20:
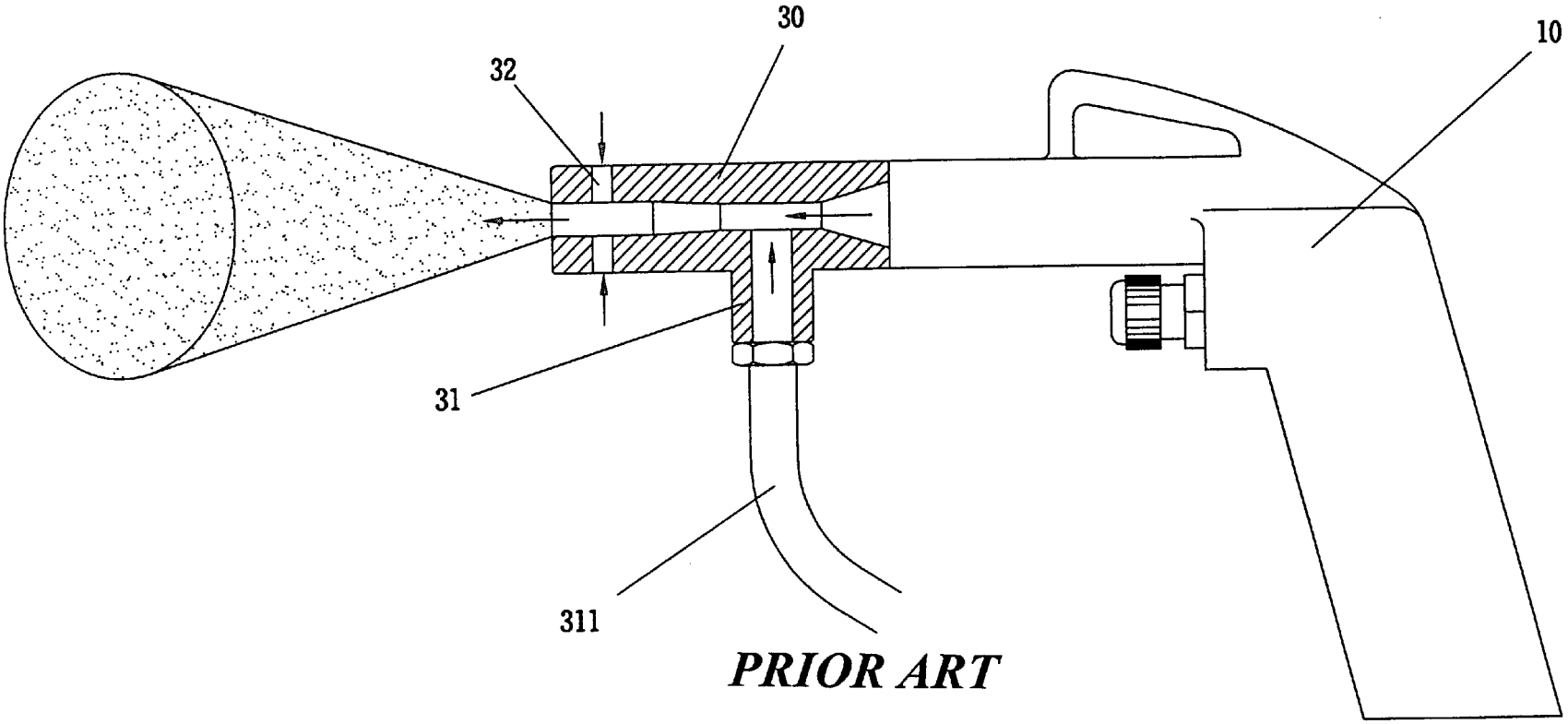
PRIOR ART FIG. 20
FIG. 20 is a schematic drawing of the conventional painting gun.

Additionally, referring to FIG. 17, by means of an adapter 85, a paint can 96 is fixed on the manifold 916 of the nozzle carrier to assemble a painting gun.

I claim:

1. A multipurpose air fountain, comprising:

an air blast gun having a blowpipe, said blowpipe having internal threads formed at an output end thereof;

a versatile adapter having a first end threadedly engaged with said output end of said blowpipe, a second end of said versatile adapter having threads formed thereon; and, a spraying adapter threadedly engaged to said second end of said versatile adapter, said spraying adapter including:

a. a splicing sleeve threadedly coupled to said versatile adapter;

b. a nozzle valve having a fitting section formed on one end thereof and disposed in said splicing sleeve, a nozzle section formed on an opposing end of said nozzle valve, and a threaded portion intermediate said nozzle section and said fitting section, said nozzle valve having a through bore extending between said opposing ends thereof and said nozzle section has a pair of side-wind holes formed therein in open communication with said through bore;

c. a nozzle carrier having an inlet opening formed on a first end coupled to said threaded portion of said nozzle valve and a an outlet nipple formed on an second end thereof, said nozzle carrier having a jet exhaust bore formed between said inlet opening and second ends thereof, at least a portion of said nozzle section of said nozzle valve being disposed in said jet exhaust bore and said side-wind holes being in open communication with said inlet opening, said nozzle carrier having a manifold formed on a side thereof, said manifold having a housing hole formed therein in open communication with said jet exhaust bore, said housing hole having a conically shaped portion connecting said housing hole to said jet exhaust bore, said nozzle carrier having a diversion hole extending between said inlet opening and said housing hole to provide passage of compressed air from said inlet opening to said housing hole;

d. a fitting valve disposed in said housing hole adjacent said conically shaped portion, said fitting valve having a pair of spaced flange and an annular recess formed therebetween, said annular recess being disposed in aligned relationship with said diversion hole and one of said flanges having a plurality of openings formed therethrough to provide open communication between said annular recess and said conically shaped portion of said housing hole; and, e. a pipe fitting secured to said manifold in said housing hole, whereby a high suction is formed at said pipe fitting responsive to compressed air being passed through said nozzle section for drawing a fluid into said jet exhaust bore through said housing hole and spraying the fluid from said outlet nipple.

* * * * *